US005874707A

United States Patent [19]

Iida et al.

[11] Patent Number: 5,874,707

[45] Date of Patent: Feb. 23, 1999

[54] PROCESSING TORCH HAVING A SEPARABLY ASSEMBLED TORCH BASE AND TORCH HEAD

[75] Inventors: Noboru Iida; Toshio Yoshimitsu; Hitoshi Sato; Toshio Yamashita, all of Kanagawa-ken, Japan

[73] Assignees: Komatsu Ltd.; Komatsu Industries Corporation, both of Tokyo, Japan

[21] Appl. No.: 860,870

[22] PCT Filed: Jan. 29, 1996

[86] PCT No.: PCT/JP96/00167

§ 371 Date: Jul. 9, 1997

§ 102(e) Date: Jul. 9, 1997

[87] PCT Pub. No.: WO96/23620

PCT Pub. Date: Aug. 8, 1996

[30] Foreign Application Priority Data

Jan. 31, 1995 [JP] Japan ..... 7-013901
Jun. 19, 1995 [JP] Japan ..... 7-151355

[51] Int. Cl.[6] ..... B23K 10/00

[52] U.S. Cl. ..... 219/121.48; 219/75; 219/121.36; 219/121.51; 439/10

[58] Field of Search ..... 219/121.48, 121.39, 219/121.51, 121.52, 74, 75, 121.36; 315/111.21; 439/10, 11, 29

[56] References Cited

U.S. PATENT DOCUMENTS 3,866,089 2/1975 Hengartner ..... 315/111.21
4,049,943 9/1977 Pratt .
4,695,702 9/1987 Gartland .
4,962,991 10/1990 Carvalho ..... 350/96.21
5,328,516 7/1994 Dietiker .

FOREIGN PATENT DOCUMENTS

0573653 A1 12/1993 European Pat. Off. .
57-44467 3/1982 Japan .
60-9586 1/1985 Japan .
61-159284 7/1986 Japan .
62-96968 6/1987 Japan .
62-275580 11/1987 Japan .
63-13793 3/1988 Japan .
3-27309 4/1991 Japan .
5-5589 1/1993 Japan .
5-19186 5/1993 Japan .
6-198450 7/1994 Japan .

*Primary Examiner*—Mark H. Paschall
*Attorney, Agent, or Firm*—Frishauf, Holtz, Goodman, Langer & Chick

[57] ABSTRACT

A processing torch having a separably assembled torch base and torch head includes a first ring member rotatably provided on an outer periphery of one of the torch base and the torch head, and a second ring member fixed on the other one of the torch base and the torch head. An engaging projection is provided on one of the first and second ring members, and an inclined track provided on the other of the first and second ring members for engaging with the engaging projection. In addition, an elastic biasing member is provided for increasing an engaging force between the inclined track and the engaging projection so as to sealingly engage the inclined track and the engaging projection. Connection and disconnection between the torch base and the torch head are performed by rotation of at least one of the first and second ring members.

20 Claims, 11 Drawing Sheets

PROCESSING TORCH HAVING A SEPARABLY ASSEMBLED TORCH BASE AND TORCH HEAD

TECHNICAL FIELD

The present invention relates to a processing torch, such as a plasma torch, in which a torch body can be assembled separably into a torch base and a torch head.

BACKGROUND ART

A first conventional fixing means (1) for a connecting portion between the torch base and the torch head is a cap nut type threading structure as disclosed in the Japanese Examined Patent Publication No. Heisei 3-27309 and Japanese Examined Patent Publication No. Heisei 5-5589.

A second conventional fixing means (2) is the combination of a claw shaped projecting portion which is provided on one of the torch head and the torch base and inclined projection which is provided on the other of the torch head and the torch base so as to establish thread-type engagement between the torch head and the torch body by relative rotation, as disclosed in Japanese Examined Patent Publication No. Showa 63-13793 and Japanese Unexamined Utility Model Publication No. Heisei 3-14076.

A third conventional fixing means (3) is a quick joint system, in which a steel ball is engaged with a recessed portion, as disclosed in Japanese Examined Utility Model Publication No. Showa 5-19186 and Japanese Unexamined Patent Publication No. Heisei 6-198450.

In the processing torch, expendables, such as an electrode, a nozzle and so forth, are included. For reducing the burden of exchanging, and for shortening of exchanging time, a separable assembling type processing torch has been considered, whereby when the torch head is released from the torch base, a water passage is separated at the connecting portion to cause leakage of the water to make the connecting surface wet.

Upon separation of the torch head and the torch base, a water pump is stopped. The water may not flow in the connecting portion. Therefore, it is considered that leakage of water may not be caused. However, water remains in the path from the pump and the torch, and this remaining water may flow out from the connecting portion upon separation, to cause water leakage. Then, upon arc firing, electric leakage or insulation failure can be caused.

Therefore, in order to prevent the water leakage, it becomes necessary to have a water stop mechanism upon separation of the torch. The one disclosed in Japanese Unexamined Patent Publication No. Heisei 6-198450 and Japanese Unexamined Patent Publication No. Showa 62-275580, while a difference of water passage and gas passage is present, closes the passage upon separation, and upon assembling, the passage is opened by the projection.

The above prior art (1) is reliable as a secure fixing means, but the cap nut has to be rotated for several turns upon connection and separation, resulting in a long period for connection and separation. Certain measure may be taken by making the thread pitch of the cap nut greater to reduce rotation angle for threading. However, when the pitch is made greater, greater rotation torque becomes necessary to exert the same threading force. Therefore, it is not expedient to provide the greater pitch for significant load upon exchanging of the torch head. On the other hand, in case of the cap nut, it is easy to cause crushing of the thread. Thus, in consideration of automatic exchange by a machine, special measure has to be taken so as not to crush the thread.

In the above-mentioned prior art (2), the claw shaped projection is hooked to the projection with an inclination to generate an axial force by the inclination without using threading. In this system, sufficient tightening which can not be established or engagement which can be easily loosened results when an error occurs in the relative position of the projections in the axial direction. Therefore, in order to be certainly fixed, adjustment of both projections becomes necessary. Also, since a plurality of torch heads are connected as exchanged to one torch base, adjustment of the relative position of the projections becomes necessary for every torch head, resulting in a long period for performing an exchanging operation.

Furthermore, another problem of the foregoing prior art (2) is that, for the structure to establish slip contact between the projections with respect to each other, if the contact surface is worn, the relative position of the projections may diverge to make the axial biasing force smaller to require re-adjustment of the relative position between the projections. On the other hand, the gradient of the spiral projection is determined by an angle depending upon a required axial motion magnitude and rotatable angle. A 2 to 5 mm axial motion magnitude from abutment of an O-ring at the inserting portion should be required. When the engaging portions of respective projections are formed at two portions on the circumference, the rotation angle becomes 180° and the gradient is determined based thereon. However, since the thus determined gradient is relatively large, a rather large rotational torque becomes necessary for obtaining sufficient axial force making it difficult to connect and separate manually.

Furthermore, in the above-mentioned prior art (3), connection can be completed by inserting the torch head into the torch base in the axial direction and thus is advantageous to be quite easily connected and disconnected. However, this holds a drawback because a small pushing force in the axial direction at the connecting portion to causes a play in the axial direction. Therefore, a complicated structure becomes necessary for generating a sufficient pressure in the axial direction to make the connecting portion large. In the construction disclosed in Japanese Examined Utility Model Publication No. Heisei 5-19186, axial depression force is generated by means of a spring. However, since the depression force becomes the force necessary upon insertion, when the spring force is set to permit manual loading, sufficient axial depression force cannot be obtained.

The reason why sufficient axial depression force is necessary at the connecting portion is that the torch head can be offset from the torch base due to vibration or so forth due to movement thereof to cause offset of the tip position of the torch to cause an adverse influence on cutting performance. Also, when an O-ring is present on the connecting surface, further depression force becomes necessary to make sealing effective. In the case where the connecting structure requires surface pressure for flowing sufficient plasma current, further axial depression force becomes necessary.

The seal surface of the inserting portion having the water passage and the gas passage of the torch base and the torch head in the processing torch, is generally straight. With respect to the O-ring provided at this portion, axial force becomes necessary from the beginning of insertion to make connection and disconnection difficult. The structure where the seal surface of the inserting portion is formed into a tapered shape has been disclosed in Japanese Examined Patent Publication No. Heisei 3-27309. In practice, an O-ring for sealing becomes necessary. At this time, in order to form coaxial passages, the inner diameter of the O-ring becomes large to make a total contact area of the O-ring large. Accordingly, a large axial force becomes necessary to crush the O-ring for establishing a seal On the other hand, concerning water leakage upon separation in the connecting portion of the water passage, this can be prevented by applying the opening and closing valve disclosed in Japanese Unexamined Patent Publication No. Heisei 6-198450 and Japanese Unexamined Patent Publication No. Showa 62-275580. In such construction, when the connecting portion is disconnected during operation of the pump, the valve is closed to build-up a dangerously high pressure within the piping (connecting portion) between the pump and the valve. Furthermore, an impulsive load may act on the pump to cause failure. On the other hand, in the case of the separable type torch as disclosed in Japanese Unexamined Patent Publication No. Heisei 6-198450, when a nozzle at the tip end, an electrode or so forth is to be exchanged in the condition where the connecting portion is connected, water leakage should be caused since the valve is held open.

In view of the problems set forth above, it is a first object of the present invention to provide a processing torch which can be easily be separated from and connected to a separably assembling type torch main body manually, which can effectively seal a connecting portion of a water passage or a gas passage in the torch main body, and which can prevent water leakage even upon exchanging of expendables or upon separation.

On the other hand, in the case of the conventional separable type torch, when the torch head is separated with respect to the torch base, the water passage is separated at the connecting portion. Therefore, a connecting portion of the water passage is provided with a water stop valve for preventing the water leakage which can automatically close the water passage in response to separation of the torch head.

In the particular structure disclosed in Japanese Unexamined Patent Publication No. Showa 60-9586, water stop valves for water passages of an in-flow side and an out-flow side are arranged at positions distanced in a direction perpendicular to an axis of the torch base. Respective water stop valves are opened by connection of the torch head and closed in response to separation.

On the other hand, in the case of this kind of separable type torch, a current to the electrode of the torch head flows to the electrode from the torch base to the torch head. At this time, the foregoing current may flow even to the water stop portion provided in the water passage, when these structural parts are electrically conductive bodies.

However, in the case of the water stop structure of the water passage as disclosed in Japanese Unexamined Patent Publication No. 60-9586, it becomes necessary to separately provide two water stop valves of the same structure, separately. Therefore, this prevents the connecting portion from being constructed in a compact manner, and requires a greater number of processing process making it difficult to lower the cost thereof.

On the other hand, the passages at the in-flow side and the out-flow side mutually communicated with via respective water stop valves are provided separately at the base end side of the torch head to make the processing at this portion troublesome.

Also, when the electrode current flows through the water stop valve in the water passage, particularly, when the current flows through the spring for stopping water biasing the valve body of the water stop valve in the closing direction, the spring for stopping water may be melted down since the current is a large current and the wire forming the spring for stopping water has a small diameter, thereby spoiling the water stop function.

In view of the problems set forth above, a second object of the present invention is to provide a processing torch which can simplify a construction of a water stop valve for preventing water leakage at the connecting portion in respective water passages for inflow and outflow, which permits the connecting portion to be compact, which permits significant reduction of the processing cost, which can prevent the electrode current from flowing through a spring for stopping water in respective water stop valves, and which and can prevent the spring from melting down.

DISCLOSURE OF THE INVENTION

In order to accomplish the foregoing first object, according to the first aspect of the present invention, there is provided a processing torch, in which a torch body is separably assembled with a torch base and a torch head, characterized in that:

a ring member is rotatably provided on the outer periphery of one of the torch base and the torch head, and another ring member is fixed on the other, an engaging projection is provided on one of both ring members and a inclined track is provided on the other to engage the engaging projection with the inclined track, an elastic member biasing for increasing engaging force between the inclined track and the engaging projection, and wherein connection and disconnection between the torch base and the torch head are performed by rotation of the ring member.

With the construction set forth above, since the torch base and the torch head of the processing torch can be assembled and separated by bayonet coupling structure. Therefore, both are easily connected and disconnected manually. Also, while connected, since biasing force by the spring is constantly act on the connecting portion, the connecting portion can constantly maintain the tight connecting condition, and may not be loosened even by vibration or impact.

On the other hand, the connecting member, such as the ring member or so forth is supported by the spring member, so that if a slight dimensional error is present between the engaging groove and the engaging projection, it can be absorbed by flexure of the spring member to permit the connection of the torch base and the torch head.

On the other hand, in the foregoing construction, it is preferred that an inclination of the inclined track is steep in the vicinity of an inlet portion and is gentle in other portion. Thus, in the initial stage of the coupling, an axial movement is quickly caused in the large pitch, and subsequently, an axial movement is cause in small pitch so that the coupling with large coupling force can be established with small force. As a result, the coupling can be done quickly and easily.

On the other hand, in the construction set forth above, it is desirable that the inclined track is provided with a return preventing means for no-returning of the engaging projection.

Also, in the construction set forth above, it is desirable that both rings mutually engage at the portions outside of the engaging portion of the inclined track and the engaging projection, and that the engaging portion has a sealing structure.

Also, in the construction set forth above, connecting members of torch base side and torch head side of a medium passage may be formed into tapered-shaped configuration to tightly engage with each other, and a sealing member is disposed between mating surfaces of the connecting members. Thus, the connecting in the medium passage at the connecting portion between the torch base and the torch head can be established without any leakage.

In the construction set forth above, it is desirable that a no-return valve is provided in a passage on the torch base side of a medium passage. Thus, as long as the supply of the medium is stopped, the medium in the medium circuit is enclosed in the torch base side. As a result, upon the separation at the connecting portion, or the exchanging of expendables in the connected condition, the leakage of medium can be avoided.

Furthermore, it is desirable in the foregoing construction that a no-return valve is provided in the vicinity of a connecting portion.

In order to accomplish the second object of the present invention, according to the second aspect of the invention, there is provided a processing torch, in which a torch body is separably assembled with a torch base and a torch head, characterized in that:

a plurality of medium passages are provided in one connecting portion between the torch base and the torch head.

With the construction set forth above, the medium passage for inflow and outflow, for example provided in the torch base and the torch head, can be aggregately provided at one portion to make the connecting portion thinner and compact.

In the construction set forth above, it is preferable that medium stop valves are provided in respective ones of a plurality of medium passages, and that there are provided opening and closing members for opening and closing the medium stop valves substantially at the same timing, upon separating and assembling of the torch base and the torch head.

In the foregoing construction, it is desirable that the plurality of medium passages are provided coaxially or in parallel.

Furthermore, in the foregoing construction, it is desirable that at least one of a member forming the medium stop valve and the opening and closing member for opening and closing the medium stop valve is non-conductive. Thus, a large current for plasma will never flow through the spring employed in the medium stop valve, and melting down of the spring which can be caused by the flow of large current is prevented.

On the other hand, according to the third aspect of the present invention, there is provided a processing torch, in which a torch body is separably assembled with a torch base and a torch head, characterized in that:

a connecting portion between the torch base and the torch head is exchangeable.

BRIEF DESCRIPTION OF THE DRAWINGS

The present invention will be understood more fully from the detailed description given hereinafter and from the accompanying drawings of the preferred embodiments of the present invention, which, however, should not be taken to be limitative to the present invention, but are for explanation and understanding only.

In the drawings.

BEST MODE FOR IMPLEMENTING THE PRESENT INVENTION

The preferred embodiment of the processing torch of the present invention will be discussed hereinafter with reference to the accompanying drawings.

The first embodiment of the processing torch according to the invention will be discussed with reference to FIGS. 1 and 2.

Figure 1:
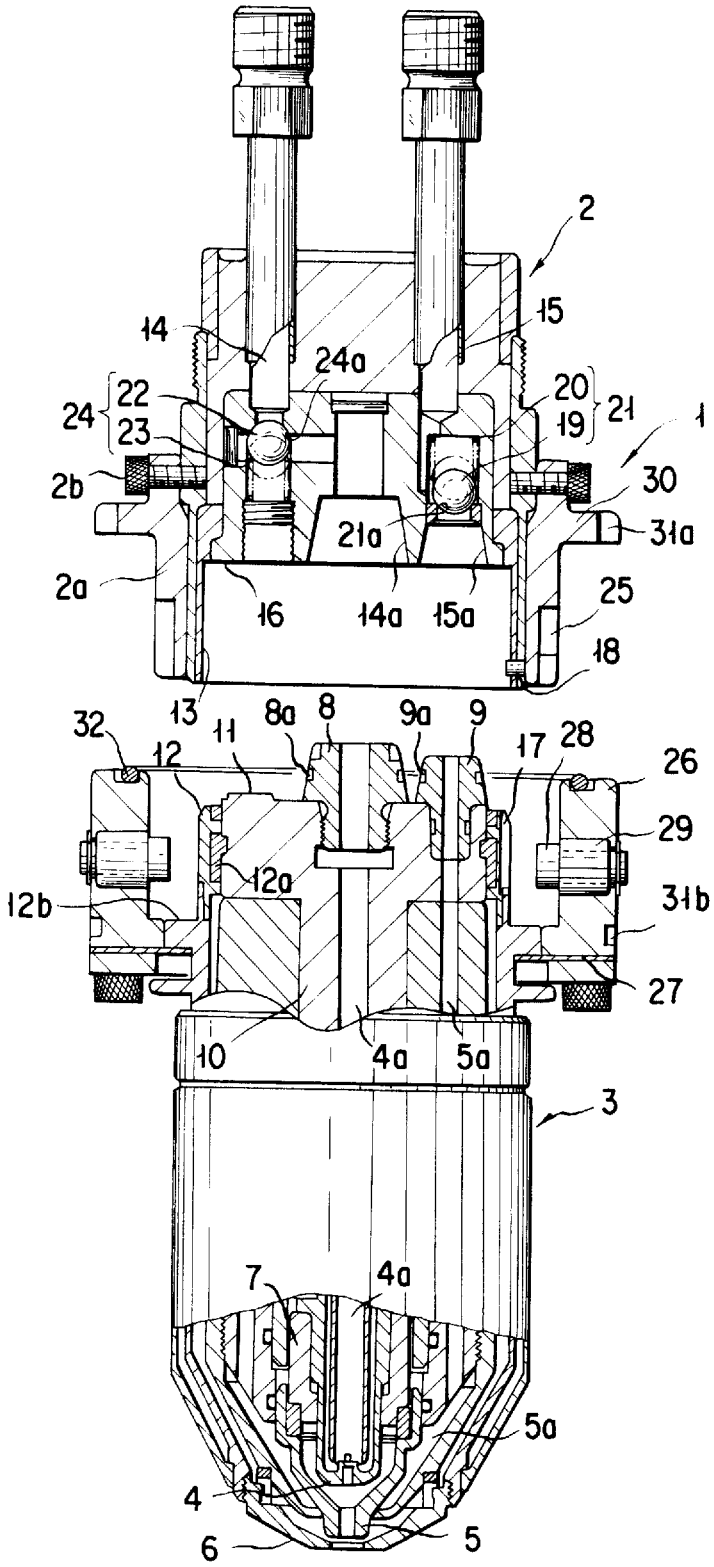
FIG. 1 is a exploded perspective view of the first embodiment of a processing torch according to the present invention.

In FIG. 1, 1 denotes a processing torch, in which a torch base 2 and a torch head 3 can be assembled separably. On a tip end of the torch head 3, an electrode 4, a nozzle 5, a shield cap 6 and so forth are provided similarly to the tip end structure of the normal processing torch. Then, on the inside of the electrode 4 and the outside of the nozzle 5, cooling water passages 4*a* and 5*a* are provided. By cooling water flowing therethrough, the electrode 4 and the nozzle 5 are cooled. It should be noted that the members outside of the nozzle 5 are electrically insulated by an insulation cylinder 7.

Also, on the base end portion of the torch head 3, an inflow valve side projecting portion 8 and a return valve side projecting portion 9 communicated with the cooling water passages 4*a* and 5*a*, respectively, are projected. These both projecting portions 8 and 9 are formed into tapered shaped configuration and fitted with O-rings 8*a* and 9*a* on the outer periphery. On the other hand, on the base end of a core portion of the torch head 3, a head side connecting surface 11 electrically connected to the torch base 2 side is provided.

It should be noted that, while it is not illustrated on the drawings, on the torch head 3, respective supply passages for a working medium gas to be ejected toward the tip end portion of the electrode 5 and an assist gas to be ejected between the nozzle 5 and the nozzle cap 6 are extended from the tip end to the base end. These passages are connected to the passages on the side of the torch base 2 by connecting the torch head 3 to the torch base 2. Constructions of the connecting portions of these gas passages are the same as that of the connecting portion of the foregoing cooling water passages.

On the base end of the torch head 3, a cylindrical member 12 is fitted via an insulation member 12*a*. By inserting an inner cylindrical portion 13 into the torch base 2 into the cylindrical member 12, the torch head 3 and the torch base 2 are connected. On the bottom surface of the inner cylindrical portion 13 of the torch base 2, an inflow valve side recessed portion 14*a* and a return valve side recessed portion 15*a* formed into reverse tapered shape for tightly engaging with the inflow side projecting portion 8 and the return side projecting portion 9 of the torch head 3, respectively, are provided. The inflow passage 14 and the return passage 15 are communicated with the recessed portions 14*a* and 15*a*, respectively. Also, on the bottom surface of the inner cylindrical portion 13, a base side connecting surface 16 contacting with a head side connecting surface 11 of the torch head 3 is provided.

On one of the outer peripheral surface of the cylindrical member 12 of the torch head 3 and the inner peripheral surface of the inner cylindrical portion 13 of the torch base 2, a positioning groove 17 is provided, and a positioning pin 18 engaging with the positioning groove is provided on the other. By engaging the cylindrical member 12 with the inner cylindrical portion 13 with engaging the position pin and the positioning groove, the connection can be established without causing a phase error of the cooling water passage and the not shown gas passage.

On the bottom portion of the return side recessed portion 15*a* of the torch base 2, a no-return valve 21 constituted of a ball 19, a spring 20 and a valve seat 21*a*, is provided. On the other hand, in the inflow passage 14 of the torch base 2, a no-return valve 24 constituted of a ball 22, a spring 23 and a valve seat 24*a*, is provided. It should be noted that the no-return valves 21 and 24 are provided in the vicinity of the recessed portions 14*a* and 15*a*, respectively.

On the end portion of the torch base 2, a ring member 2*a* is fixed by means of a bolt 2*b*. On the outer periphery of the ring member 2*a*, a plurality of engaging grooves 25 to be inclined tracks for bayonet coupling are formed to form a part of spiral. For instance, two engaging grooves are provided with angular offset of 180° in the circumferential direction.

On the other hand, on the out side of the end of the torch head 3, a ring member 26 is engaged in a direction parallel to the axis via a leaf spring 27 having flexibility. On the inner surface of the ring member 26, an engaging projection 28 for engaging with respective engaging grooves 25 are provided. It should be noted that the engaging projection 28 is supported on the ring member 26 in a condition rotatable in the circumferential direction via a bearing 29.

The engaging groove 25 is constructed with an inlet portion 25*a*, to which the engaging projection 28 is engaged in the axial direction, a inclined portion 25*b*, on which the engaging projection 28 engages slidingly to move in a direction forming a part of the spiral, and a horizontal portion 25*c* at the terminating end. Then, the inclined portion has a steep inclination at the portion close to the inlet portion 25*a* and a gentle inclination at the portion close to the terminating end portion. The inclination of the inclined portion 25*b* is varied in two stages.

On the other hand, the leaf spring 27 mounting the ring member 26 to the torch head 3 is divided into a plurality of pieces in the circumferential direction. Each of the divided pieces of the leaf spring 27 is rotatable about the torch head 3 and movable in the axial direction, and is engaged with a flange portion 12*b* formed on the outer periphery of the cylindrical member 12 so that, at least, they may not loose away from the torch head 3. To these leaf springs 27, the ring member 26 is fixed.

On the other hand, to a flange portion 30 of the torch base 2 and the ring member 26 of the torch head 3 side, positioning marking 31*a* and 31*b* respectively corresponding to the inlet portion 25*a* of the engaging groove 25 and the engaging projection 28 are respectively provided in recessed form so as to be seen externally.

Furthermore, on the end surface portion of the ring member 26, an O-ring 32 contacting with the flange portion 30 on the torch base 2 side is engaged.

The engagement relationship between the engaging projection 28 projected on the ring member 26 and the engaging groove 25 of the torch base side is that the connecting surfaces of the torch base 2 and the torch head 3 are abut with each other at the stage where the engaging projection 28 is engaged with the horizontal portion 25*c* of the engaging groove 25, to flex the leaf spring 27 toward the torch base 2 side, and the engaging projection 28 is biased toward the horizontal portion 25*c* of the engaging groove 25 by spring to engage thereto. At this condition, the torch base 2 and the torch head 3 are tightly engaged.

Next, in the foregoing first embodiment, the procedure for connecting and disconnecting the torch head 3 to and from the torch base 2 will be discussed hereinafter.

To the inner cylindrical portion 13 of the torch base 2, the cylindrical portion 12 of the torch head 2 is engaged with engaging the positioning pin 18 to the positioning groove 17. In conjunction therewith, the engaging projection of the ring member 26 is engaged from the inlet portion 25*a* of the engaging groove 25 on the torch base 2 side. At this condition, the inflow valve side projecting portion 8 and the return valve side projection 9 on the torch head 3 side are respectively inserted into the inflow valve side recessed portion 14*a* and the return valve side recessed portion 15*a*. The O-rings 8*a* and 9*a* therebetween are situated in the condition to lightly contact with the recessed portions 14*a* and 15*a*. Thus, inserting operation can be performed with a small force. And, at this time, the ring member 26 is positioned by using the positioning markings 31*a* and 31*b*.

Next, the ring member 26 is rotated (angular displacement over 90° in right direction in the shown embodiment). By this, the engaging projection 28 moved in the axial direction in conjunction with movement along the engaging groove 25 to establish bayonet coupling therebetween.

At this time, since the steep inclination is provided at the portion of the inclined portion 25*b* close to the inlet portion 25*a* of the engaging groove 25, by the initial rotation of the ring member 26, the engaging projection 28 is moved in the axial direction in large magnitude together with the torch head 3. At this time, since it is only required a force in the axial direction for causing elastic deformation of the O-rings 8*a* and 9*a*, not so large rotational force is required despite of the fact that the inclination is steep. Subsequently, the engaging projection 28 engages with the portion having gentle inclination of the inclined portion 25*b* to apply large axial force with small rotational force. Thus, the torch head 3 can be firmly depressed in the axial direction onto the torch base 2. Then, the engaging projection 28 engages the horizontal portion 25*c* at the terminating end of the engaging groove 25 to complete connecting operation. Then, the ring member 26 is engaged and fixed to the torch base 2 side.

Figure 2:
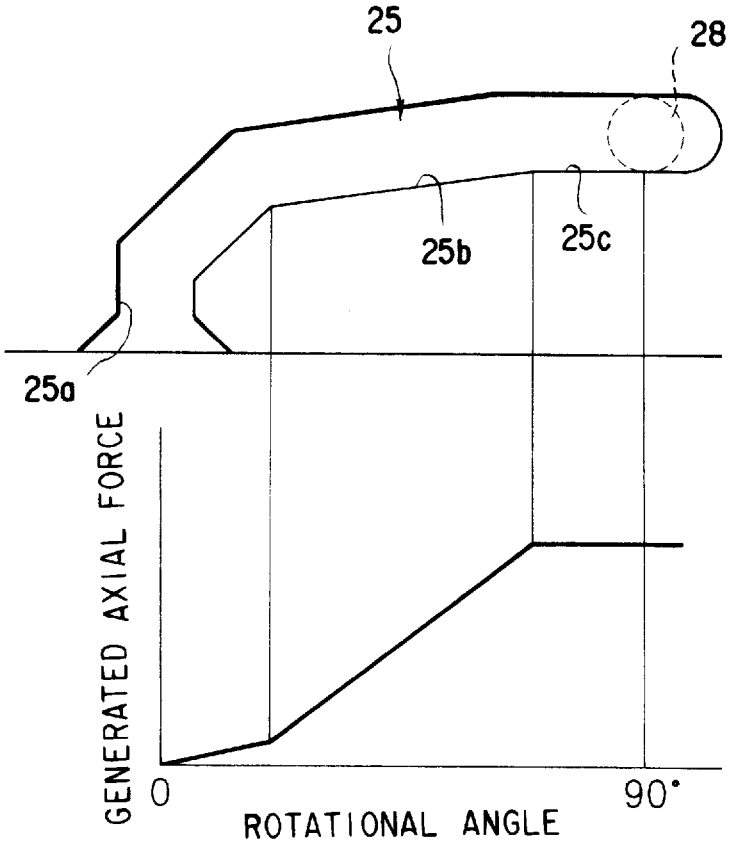
FIG. 2 is an explanatory illustration showing a relationship between a shape of an engaging groove in the first embodiment and a generated axial force versus a rotational angle upon bayonet coupling, in which an engaging projection is engaged with the engaging groove.

At this time, a relationship between the rotational angle of the ring member 26 and the axial force generated is as shown in FIG. 2. In this embodiment, the rotational angle of the ring member 26 is set at 90°.

And, at this time, since the ring member 26 is resiliently supported on the leaf spring 27, the torch head 3 is constantly biased in the connecting direction by the biasing force generated by flexure of the leaf spring 27. And also, in this connecting condition, the end surface portion of the ring member 26 is contacted with the flange portion 30 of the torch base 2 under pressure to establish a seal. Therefore, the connecting portion can be protected from the powder dust. Besides, a dust seal can be used in place of O-ring to protect from the powder dust.

Upon connection of the torch base 2 and the torch head 3, the inflow side of the cooling water passage is communicated by engagement between the inflow valve side projecting portion 8 and the inflow valve side recessed portion 14*a*, and the return side is communicated by engagement of the return valve side projecting portion 9 and the return valve side recessed portion 15*a*.

Then, the cooling water flows with opening the no-return valve 24 in the inflow passage under pressure to flow thereinto, and the water in the return side opens the no-return valve 21 in the return passage under pressure to permit flow out.

The separation of the torch head 3 from the torch base 2 is performed through the procedure reverse to the foregoing.

Upon the separation, since the supply of the cooling water is stopped, the water in the inflow passage for the cooling water is sealed by no-return valve 24. Also, the water in the return passage is sealed by the no-return valve 21. Thus, the cooling water will never cause a leakage of the cooling water. At this time, water present between the both no-return valves 21, 24 to the valve side recessed portions 14*a* and 15*a* may flows out. Since positions of both no-return valves 21 and 24 are close to the valve side recessed portions 14*a* and 15*a*, the water amount can be small and will not cause a significant problem.

Figure 3A:
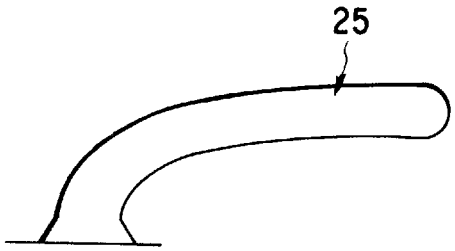
FIGS. 3A, 3B and 3C are general illustrations of modification of the foregoing engaging grooves, respectively.
Figure 3B:
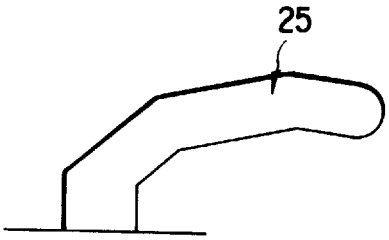
Figure 3C:
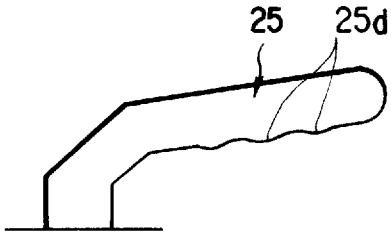

In the first embodiment, the engaging groove 25 as the inclined track for bayonet coupling is varied the inclination in stepwise fashion. However, as shown in FIG. 3A, it is possible to form the engaging groove 25 inclined in arc-shaped stepless fashion. On the other hand, as shown in FIG. 3B, the terminal end portion of the engaging groove 25 is provided with the reverse inclination. At this time, the magnitude of the reverse inclination is quite small, the loosening of coupling by the reverse inclination is absorbed by the resilient deformation of the leaf spring 27. On the other hand, as shown in FIG. 3C, it is possible to prevent the coupling from loosening by providing a plurality of recessed portions in the engaging groove 25, to which the engaging projection 28 is engaged.

Figure 4A:
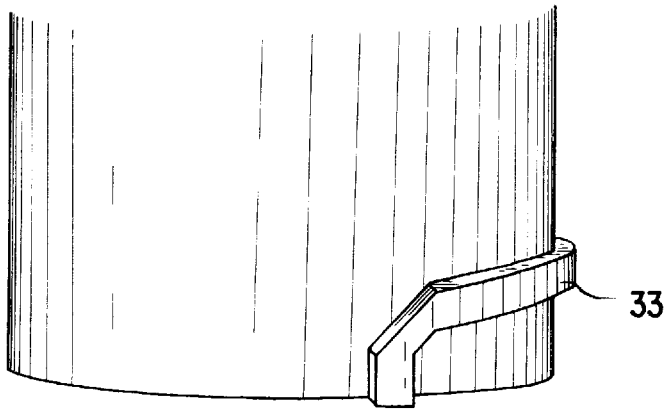
FIGS. 4A and 4B are sections showing another example of a inclined track for bayonet coupling, and engaging condition of the shown example of the inclined track and the engaging projection.
Figure 4B:
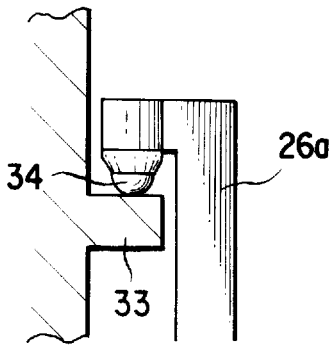

While the inclined engaging groove 25 is employed in the inclined track of the bayonet coupling portion in the foregoing first embodiment, it may be possible to employ the projecting track 33 as shown in FIG. 4A and a ball shaped (or plunger form) engaging member 34 provided on the ring member 26*a* is rotatingly contact with the upper surface of the projecting track 33 as shown in FIG. 4B.

Figure 5A:
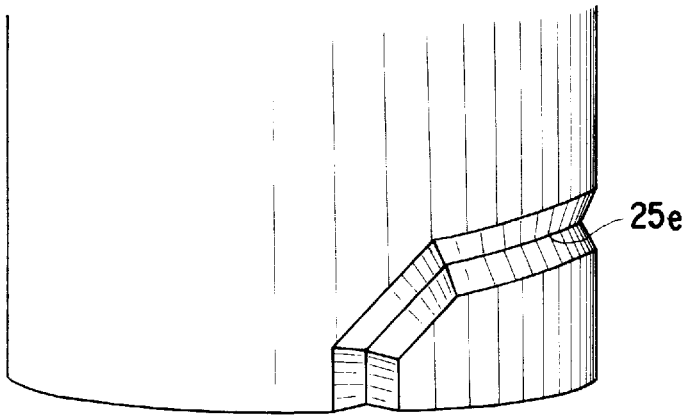
FIGS. 5A and 5B are sections showing a further example of a inclined track for bayonet coupling, and an engaging condition of the shown example of the inclined track and the engaging projection.
Figure 5B:
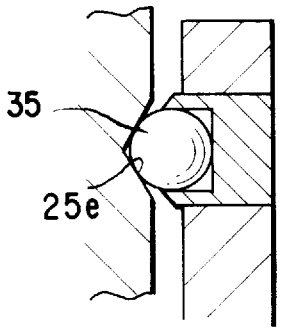

On the other hand, as shown in FIG. 5A, an engaging groove 25*e* of V-shaped cross-section are provided. By engaging the ball-shaped engaging member 25 to the engaging groove, engagement is established as shown in FIG. 5B.

Figure 6A:
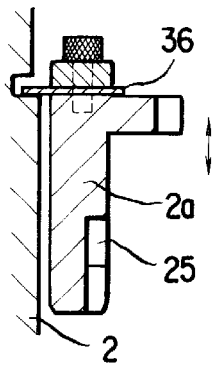
FIG. 6A is a section of another example of a ring member at a torch base side having a inclined track for bayonet coupling.

On the other hand, in the foregoing first embodiment, a construction, in which the ring member 2*a* of the torch base 2 side, provided the engaging groove 25 is fixed on the torch base 2 by the bolt 2*b*, and the ring member 26 of the torch head 3 side supporting the engaging projection 28 engaging thereto, is supported by the leaf spring 27 having flexibility in the axial direction. Conversely, as shown in FIG. 6A, the ring member 2*a* on the side of the torch base 2 may resiliently supported by the leaf spring 36 to fix the ring member 26 on the torch head 3 side on the torch head 3, may be employed.

Figure 6B:
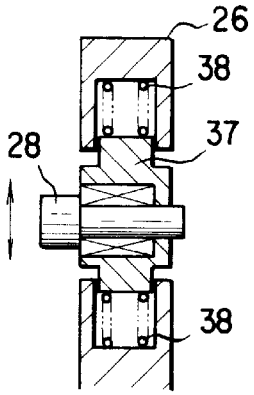
FIG. 6B is a section of a further example of a ring member at a torch base side having a inclined track for bayonet coupling.
Figure 6C:
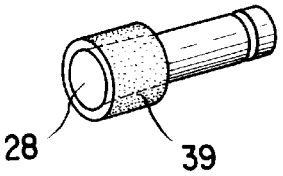
FIG. 6C is a perspective view of a still further example of an engaging projection.

It is also possible to fix both ring members 2*a* and 26 on respective of the torch base 2 and the torch head 3, and support a bearing base 37 supporting the engaging projection 28 in axially slidable fashion by biasing them to the ring member 26 of the torch head 3 side with the elastic member, such as the spring 38, rubber or so forth on both sides in the axial direction, as shown in FIG. 6B. On the other hand, as shown in FIG. 6C, it is possible to bond the elastic member 39, such as rubber or so forth, on the outer periphery of the engaging projection 28 to apply a biasing force in the axial direction to the bayonet coupling portion by the elastic force of the elastic member 39.

Figure 6D:
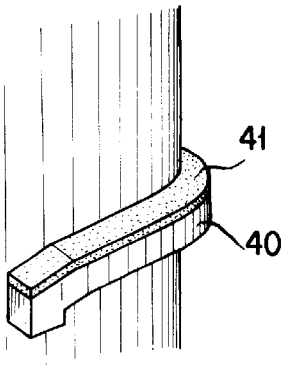
FIG. 6D is a perspective view of a still further example of the inclined track.

On the other hand, as shown in FIG. 6D, it is possible to bond the elastic member 41 on the upper surface of the inclined track 40, to contact with the engaging projection 28 to apply a biasing force in the axial direction to the bayonet coupling portion by the elastic force of the elastic member 41. On the other hand, as shown in FIG. 1, similar effect to the foregoing may be obtained by fitting the foregoing elastic member 41 on the inner surface of the engaging groove 25 contacting with the engaging projection 28.

Figure 7:
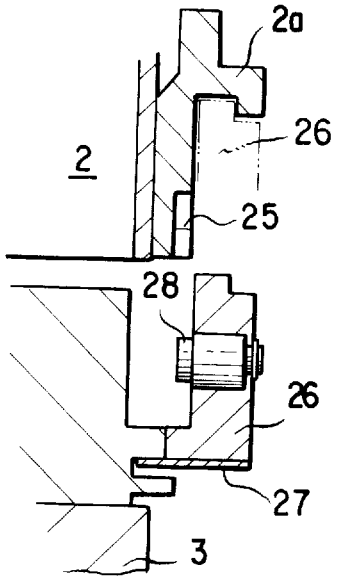
FIG. 7 is a section showing an example of engaging portion of both ring members at the torch base side and a torch head side.

Also, concerning the seal of the connecting portion between the torch base 2 and the torch head 3, as shown in FIG. 7, the top portion of the ring member 26 on the torch head 3 side engages with the groove of the ring member 2*a* of the torch base 2 side in liquid tight fashion to form a sealing structure of the connecting portion without employing the O-ring.

On the other hand, in the first embodiment, the outside constructional members of the torch base 2 and the torch head 3 are insulated from the inside conductive members by constructing them with an insulative member or so forth, or, in the alternative, to interpose the insulative member between both side members.

By the foregoing first embodiment, the separable assembling of the torch base 2 and the torch head 3 of the processing torch 1 is realized by the bayonet coupling, and thus both of them can be easily connected and disconnected manually. Then, in the connection, the biasing force in the axial direction by the spring constantly acted to the connecting portion. Therefore, the connecting portion can constantly maintain the tight connecting condition and may not be loosen by vibration or impact.

On the other hand, since the connecting member, such as the ring member 26 or so forth is supported by a spring member, even when a slight dimensional error is present in the engaging portion by the engaging groove and the engaging projection, those are absorbed by flexure of the spring member to connect the torch base 2 and the torch head 3.

On the other hand, by providing the steep inclination at the portion in the vicinity of the inlet portion and the gentle inclination at the remaining portion in the inclined track of the bayonet coupling to vary the inclination of the inclined track two or more stages. Therefore, at the initial stage of the coupling, large pitch axial movement is caused to cause swift axial movement, and subsequently an axial movement in the small pitch is caused so that the coupling with large coupling force can be established with small force. As a result, the coupling can be established quickly and easily.

Furthermore, since the members forming the connecting portions of the inflow passage, the return passage and further the not shown gas passage from the torch base 2 to the torch head 3, between the torch base 2 and the torch head 3, are formed into tapered shape for tightly engaging with each other, and the O-ring is disposed between the mating surfaces of the members, leakages in the both cooling water passages and the gas passage will never caused at the connecting portion between the torch base 2 and the torch head 3.

On the other hand, since the no-return valves are disposed in both of the cooling water inflow and return passages in the torch base 2, when the supply of the cooling water is stopped, the water in the cooling water circuit is enclosed on the torch head 2 side. As a result, when the coupling portion is separated or exchanging of the expendables on the head side in the connected condition is executed, the water leakage can be avoided.

Next, discussion will be given for the second embodiment of the processing torch according to the present invention with reference to FIGS. 8 to 10.

Figure 8:
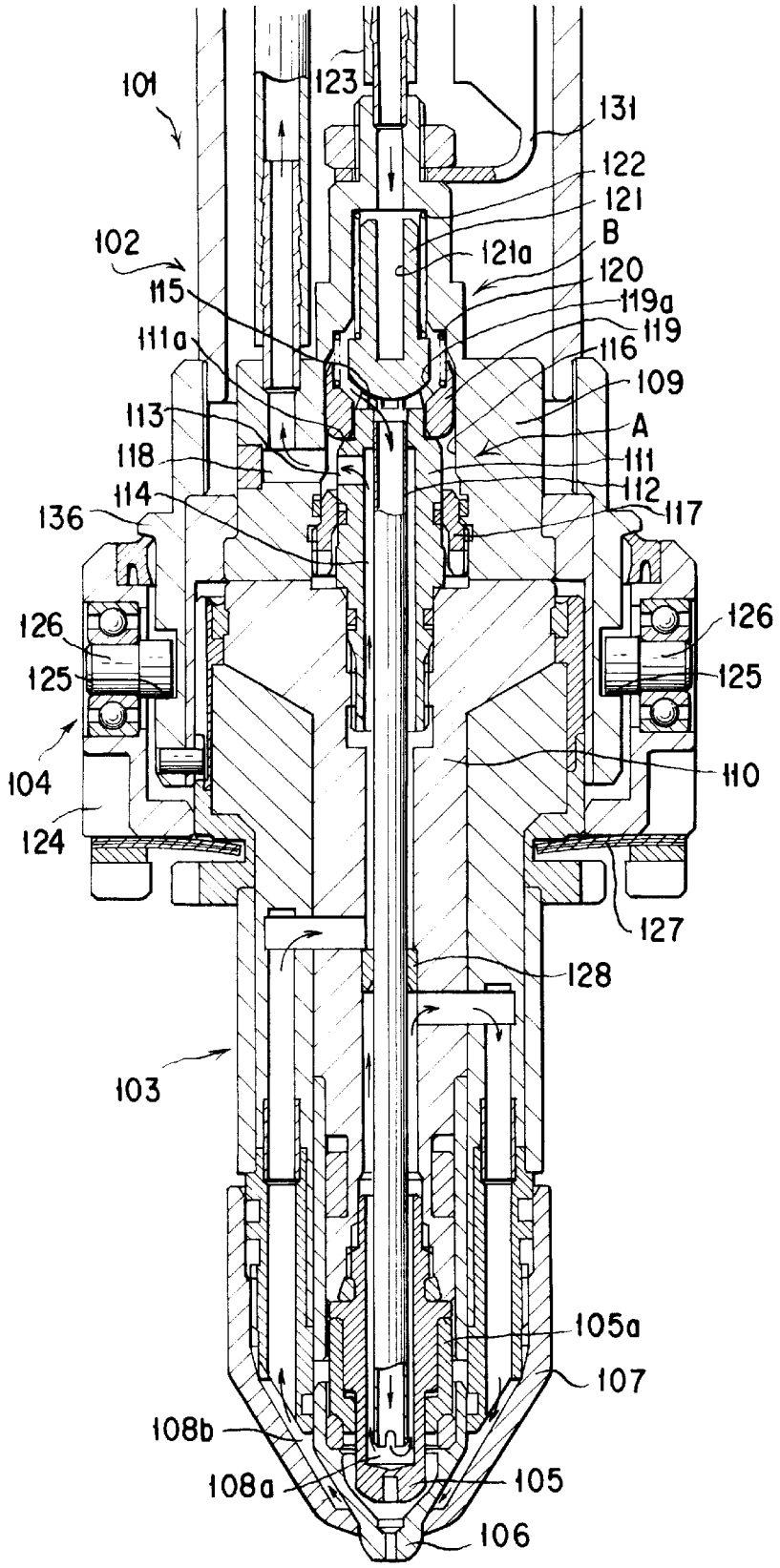
FIG. 8 is a section showing assembling condition of the torch base and the torch head of the second embodiment of a processing torch according to the invention.

In FIG. 8, 101 denotes a processing torch constructed for separably assembling a torch base 102 and a torch head 103. These torch base 102 and the torch head 103 can be connected and disconnected by a connecting device 104 of the bayonet structure similarly to the first embodiment.

Namely, from the inner surface of a bayonet type ring member 120 supported on the torch head 103 via a leaf spring 127, two pins 126, 126 are projected. On the outer peripheral surface of a ring member 136 fixed to the torch base 102, inclined grooves 125, 125 forming a part of spiral are provided. When the pins 126, 126 are engaged with these grooves 125, 125 and the torch head 103 is relatively rotated with respect to the torch base 102, both members are connected by self holding force of the pin 126 to the groove 125 and flexure of the leaf spring 127. By performing reverse operation, both members are separated.

On the tip end portion of the torch head 103, similarly to the structure of the tip end portion of the normal processing torch, an electrode 105, a nozzle 106, a shielding cap 107 or so forth are provided. Then, on the inside of the electrode 105 and the outside of the nozzle 106, cooling water passages 108*a* and 108*b* are provided, respectively so that the electrode 105, the nozzle 106 and so forth are cooled by the cooling water flowing therethrough. It should be noted that the members outside of the nozzle 106 are electrically insulated by an insulation cylinder 105*a* with respect to the electrode 105.

The connecting condition of the torch base 102 and the torch head 103 by the connecting device 104 are connected in mutually contacting condition of the end surfaces of the base body 109 of the torch base 102 side and the head body 110 of the torch head 103 side.

Then, from the head body 110, a water passage connecting cylinder 111 is projected. In the axial portion of the water passage connecting cylinder 111, a inflow pipe 112 opened at the tip end thereof is provided. On the other hand, on the outside of the inflow pipe 112, an annular outflow passage 114 communicated with a through hole 113 opening to the outer peripheral surface of the water passage connecting cylinder 111 is provided coaxially with the inflow pipe 112.

The lower end of the inflow pipe 112 opens to an annular cooling water passage 108*a* in the electrode 105. The cooling passage 108*a* is provided coaxially on the outside of the inflow pipe 112 to communicate with the outflow passage 114 of the head body 110 via the cooling water passage 108*b* located outside of the nozzle 106.

On tip end side of the through hole 113 on the outer peripheral surface of the tip end portion of the water passage connecting cylinder 111, an upwardly directed step portion 111*a* is provided. On the other hand, on the tip end of the water passage connecting cylinder 111, a radially extending water flow groove 115 is provided.

On the base body 109 of the torch base 102, a hole 116 to which the water passage connecting cylinder 111 is engaged is provided. Within the opening end portion of the hole 116, a bushing 117 to tightly engage with the water passage connecting cylinder 111 is engaged. Also, on the wall surface on the bottom side of the bushing 117, an outflow opening 118 is opened. On the bottom side of the bushing 117, an outflow valve 119 vertically slidable from a position to contact the lower end thereof with the end portion of the bushing 117 to close the outflow opening 118 to the position to open the outflow opening 118, is engaged. The outflow valve 119 is biased in the direction to close the outflow opening 118 by means of a spring 120. By the outflow valve 119, the spring 120 and the bushing 117, a water stop valve A on the outflow passage side is formed.

The inner diameter of the outflow valve 119 is smaller than that of the bushing 117 so that the step portion 111*a* of the water passage connecting cylinder 111 contacts with the lower end thereof to push the outflow valve 119 in the opening direction of the outflow opening 118 against the spring 120.

On the inside of the outflow valve 119, an upwardly tapered valve seat surface 119*a* is provided. On the valve seat surface 119*a*, an inflow valve 121 which is slidably engaged in the most backside of the hole 116 of the base body 109 and biased in the closing direction by means of a spring 122 is contacted. With the inflow valve 121, the spring 122 and the valve seat surface 119*a*, the inflow side water stop valve B is formed. It should be noted that the inflow valve 121 is formed with a slit 121*a* for improving an inflow efficiency of the water. Then, in the base body 109, an inflow pipe 123 communicated with the most backside of the hole 116 is connected.

The length from the step portion 111*a* to the tip end of the water passage connecting cylinder 111 is set in a length to push the inflow valve 121 to be higher than the outflow valve 119 by the tip end in the condition where the outflow valve 119 is pushed up by the stepped portion 111*a*. Therefore, in the condition where the torch head 103 is connected to the torch base, both valves 119 and 121 are opened by the water passage connection cylinder 111.

The outflow valve and the inflow valve 119 and 121 are constructed with non-conductive material, such as resin, ceramic or so forth. It should be appreciated that the springs 120 and 122 and the water passage connecting cylinder 111 may be formed of non-conductive material. In the alternative, the member which is formed with the conductive body with coating of non-conductive material may also be used.

The cooling passage 108*a* in the electrode 105 in the torch head 103 and the cooling passage 108*b* on the outside of the nozzle 106 are connected by a passage within the torch head 103. Then, a return passage from the cooling passage 108*a* in the electrode 105 and the return passage to the water stop valve A side from the cooling passage 108*b* outside of the nozzle 106 are defined by partitioning the outflow passage 114 formed coaxially with the inflow pipe 112 and outside thereof, by means of a water stop ring 128.

Figure 9:
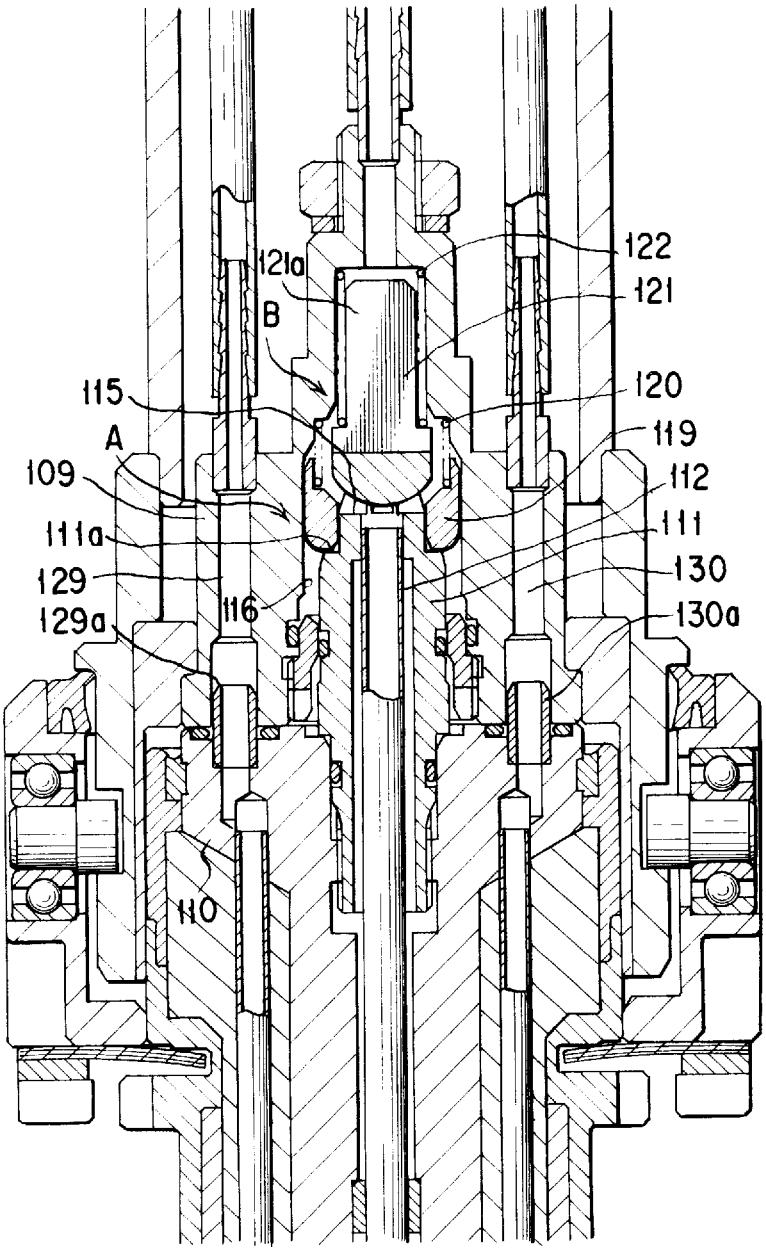
FIG. 9 is a section showing a condition where the second embodiment is rotated over 90°.

FIG. 9 is a section of the second embodiment shown in FIG. 8 at a position rotated over 90°. 129 denotes a working medium gas passage, 130 denotes an assist gas passage. These can be connected and disconnected to the base body 109 side and the head body 110 side by joint members 129*a* and 130*a*, respectively.

Next, operation of the second embodiment will be discussed hereinafter.

Figure 10:
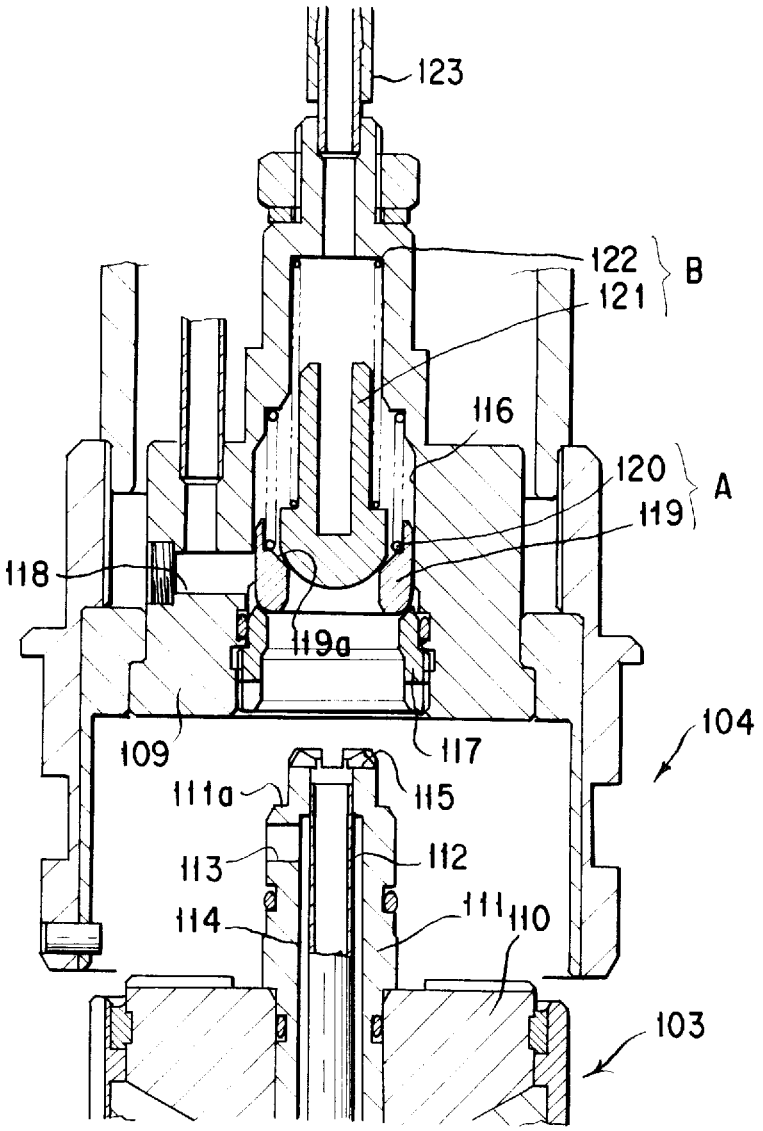
FIG. 10 is a section showing a major part of the condition where the torch base and the torch head of the second embodiment are separated.

FIG. 10 shows a condition where the torch head 103 is separated from the torch base 102. At this condition, the outflow valve 119 of the water stop valve A on the outflow passage side is moved downwardly to contact with the bush 117 as being biased by the spring 120. Therefore, the outflow opening 118 provided in the base body 109 is closed to place the outflow passage in closed position.

On the other hand, the inflow valve 121 of the water stop valve B on the inflow passage side is biased by the spring 122 to contact the inflow valve 119 of the water stop valve A on the inflow passage side onto the valve seat surface 119*a*. Thus, the inflow passage is also placed in the closed position.

Next, by connecting the torch base 102 and the torch head 103, the condition shown in FIGS. 8 and 9 is established. Namely, when the water passage connecting cylinder 111 provided on the side of the torch head 103 is inserted within the hole 109 of the torch base 102, the outflow valve 119 of the water stop valve A on the outflow passage side is pushed upwardly by the step portion 111*a* of the water passage connecting cylinder 111 to move upwardly against the spring 120 to open the outflow opening 118 to open the outflow passage.

On the other hand, at substantially the same timing, the tip end of the water passage connecting cylinder 111 contacts with the inflow valve 121 on the inflow passage side to push the latter up against the spring 122 to open the inflow passage.

At this condition, the torch base 102 and the torch head 103 are firmly connected by the connecting device 104.

Then, upon actuation of the processing torch 101, the cooling water may flow from the torch base 102 to the torch head 103 through both water stop valves A and B to cool the temperature elevating portions, such as electrode 5, the nozzle 6 and so forth.

On the other hand, at this time, the actuation current is input through a connector 131 connected to the upper end portion of the base body 109 of the torch base 102, and flows to the electrode 105 from the base body 109 to the head body 110.

However, the outflow valve 119 and the inflow valve 121 of both water stop valves A and B built in the base body 109 are formed of non-conductive material, a current may not flow through these.

Accordingly, the current will never flow through respective springs 120 and 122 which contact with respective one end of the valves 119 and 121 for biasing them in the closing direction.

Therefore, melting down of both springs 120 and 122 due to introduction of large current will never be caused.

Figure 11:
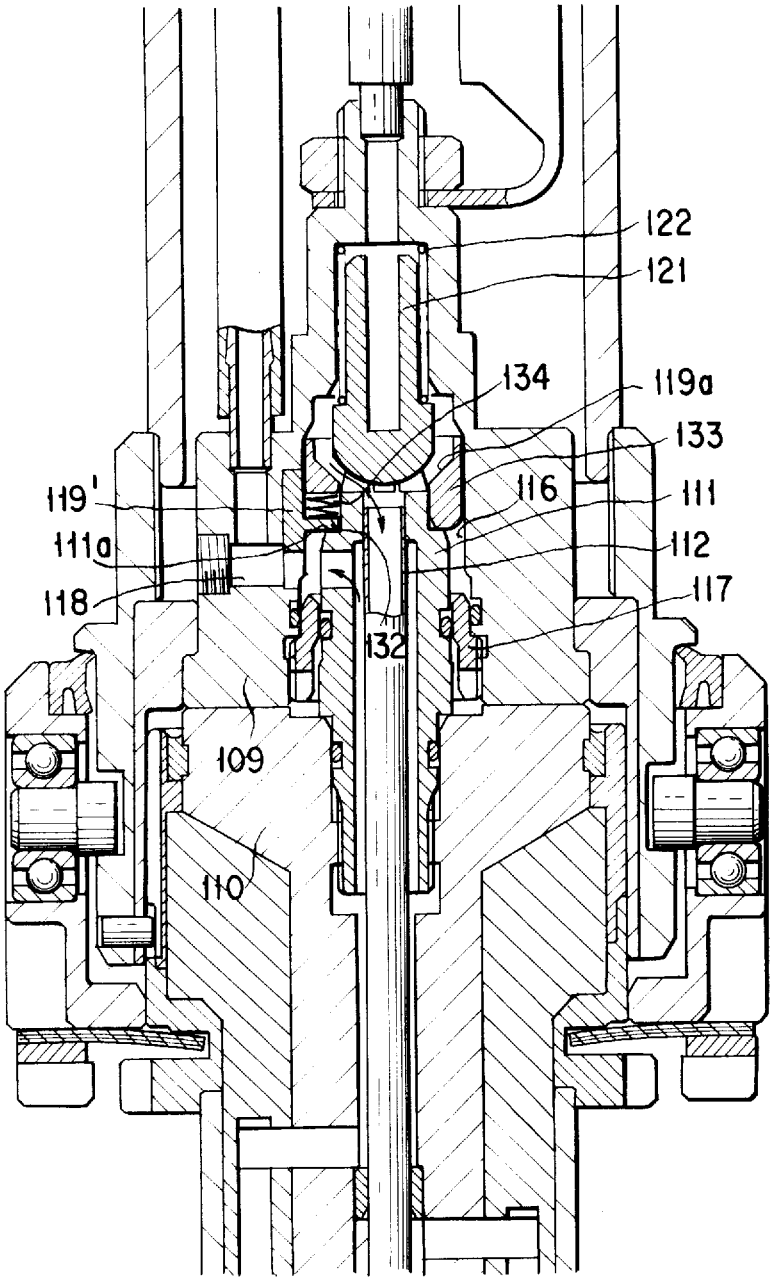
FIG. 11 is a section showing another example of the water stop valve portion.

In the second embodiment, an example where the outflow valve 119 of the water stop valve A in the outflow side is formed into a cylindrical shape, has been disclosed. However, the outflow valve 119 is required to have only a function to open and close the outflow opening 118 provided in the base body 109 according to insertion and releasing of the water passage connecting cylinder 111 into and from the hole 116. Therefore, in place of the shown construction, it is possible to construct as shown in FIG. 11, to provide a shutter 119' at a position opposing to the outflow opening 118 for opening and closing the latter, and to open the shutter 119' by pushing up a projection 132 provided on the inside of the shutter 119' by the step portion 111*a* of the water passage connecting cylinder 111 against a spring 134 disposed between the projection 132 and a valve seat member 133 of the inflow valve side. It should be appreciated that, in such case, the valve seat member 133 having the valve seat surface 119*a* to contact with the inflow valve 121 is held in a condition fixed on the base body 109.

Figure 12:
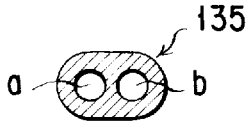
FIG. 12 is a section of another example of a pipe having both inflow and outflow passages.

On the other hand, in the second embodiment, the inflow pipe 112 forming the inflow passage of the cooling water and the outflow passage 114 provided in the head body 110 are formed into the double pipe structure. However, for the inflow passage and the outflow passage, a pipe 35, in which two passages a and b are arranged in parallel may be used, as shown in FIG. 12. On the other hand, while the second embodiment is an example employing cooling water passage, the present invention is also applicable for the passage of fluid, such as gas or so forth.

As set forth above, by the second embodiment, in the processing torch, the torch body is formed with the torch base 102 and the torch head 103, both members are connected and disconnected by the connecting means, and the water stop valves for preventing water leakage in the connecting portion of the water flowing passage for inflow and outflow are coaxially arranged at one portion, in both member. Therefore, this embodiment can make the connecting portion thin and compact and significantly reduce the processing cost.

On the other hand, in the processing torch as set forth above, a large current for plasma actuation will never flow through the spring employed in the water stop valve. Thus, the melting down of the spring due to flowing of the large current can be prevented.

Although the invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodies within a scope encompassed and equivalents thereof with respect to the feature set out in the appended claims.

We claim:

1. A processing torch having a separably assembled torch base and torch head, comprising:

a first ring member rotatably provided on an outer periphery of one of said torch base and said torch head, and a second ring member fixed on the other one of said torch base and said torch head, an engaging projection provided on one of said first and second ring members, and an inclined track provided on the other of said first and second ring members for engaging with said engaging projection, and an elastic biasing member for increasing an engaging force between said inclined track and said engaging projection so as to sealingly engage said torch base and said torch head, wherein connection and disconnection between said torch base and said torch head are performed by rotation of said first ring member.

2. A processing torch as set forth in claim 1, wherein an inclination of said inclined track is steeper in a vicinity of an inlet portion thereof than in other portions thereof.

3. A processing torch as set forth in claim 1, wherein said inclined track is provided with a return preventing means for preventing said engaging projection from returning.

4. A processing torch as set forth in claim 1, wherein said first and second ring members mutually engage each other at portions outside of an engaging portion of said inclined track and said engaging projection, and wherein said engaging portion comprises a sealing structure.

5. A processing torch as set forth in claim 1, further comprising:

connecting members provided on both said torch base and said torch head, said connecting members being formed into a tapered-shaped configuration to tightly engage with each other, and a sealing member disposed between mating surfaces of said connecting members.

6. A processing torch as set forth in claim 1, further comprising a valve provided in a passage in said torch base.

7. A processing torch as set forth in claim 1, further comprising a valve provided in a vicinity of a connecting portion between said torch base and said torch head.

8. A processing torch as set forth in claim 1, further comprising a plurality of medium passages provided in a connecting portion between said torch base and said torch head.

9. A processing torch as set forth in claim 8, further comprising:

a plurality of medium stop valves provided in respective ones of said plurality of medium passages, and an opening and closing member for opening and closing said medium stop valves substantially at a same timing upon separating and assembling of said torch base and said torch head.

10. A processing torch as set forth in claim 8, wherein said plurality of medium passages are coaxially arranged.

11. A processing torch as set forth in claim 8, wherein said plurality of medium passages are arranged in parallel.

12. A processing torch as set forth in claim 9, wherein at least one of said medium stop valves and said opening and closing member is non-conductive.

13. A processing torch as set forth in claim 1, wherein a connecting portion provided between said torch base and said torch head is exchangeable.

14. A processing torch as set forth in claim 1, wherein said inclined track is inclined in an arc-shaped and stepless manner.

15. A processing torch as set forth in claim 2, wherein said other portions of said inclined track include a plurality of recesses.

16. A processing torch as set forth in claim 1, wherein said inclined track comprises a protrusion and said engaging projection comprises a ball shaped member, and wherein said ball shaped member rotatingly contacts an upper surface of said protrusion.

17. A processing torch as set forth in claim 1, wherein said inclined track comprises a protrusion and said engaging projection comprises a plunger member, and wherein said plunger member rotatingly contacts an upper surface of said protrusion.

18. A processing torch as set forth in claim 17, wherein said upper surface of said protrusion is bonded by an elastic member.

19. A processing torch as set forth in claim 18, wherein said plunger member is bonded by an elastic member.

20. A processing torch as set forth in claim 1, wherein said inclined track comprises a groove having a V-shaped cross section and said engaging projection comprises a ball-shaped member, and wherein said ball-shaped member engages said groove.

* * * * *